US009523289B2

(12) United States Patent
Pasqualon

(10) Patent No.: US 9,523,289 B2
(45) Date of Patent: Dec. 20, 2016

(54) METHOD TO START UP A COMBINED CYCLE THERMAL PLANT FOR ENERGY PRODUCTION FROM AN OFF-STATE TO AN OPERATIONAL STATE

(75) Inventor: Ezio Pasqualon, Sittard (NL)

(73) Assignee: Stamicarbon B.V., Sittard (NL)

( * ) Notice: Subject to any disclaimer, the term of this patent is extended or adjusted under 35 U.S.C. 154(b) by 621 days.

(21) Appl. No.: 14/007,643

(22) PCT Filed: Mar. 27, 2012

(86) PCT No.: PCT/IB2012/051450

§ 371 (c)(1),
(2), (4) Date: Oct. 24, 2013

(87) PCT Pub. No.: WO2012/131575

PCT Pub. Date: Oct. 4, 2012

(65) Prior Publication Data

US 2014/0047847 A1 Feb. 20, 2014

(30) Foreign Application Priority Data

Mar. 28, 2011 (IT) ..... MI2011A0498
Mar. 30, 2011 (IT) ..... MI2011A0520

(51) Int. Cl.

| | |
|---|---|
| ***F01K 13/02*** | (2006.01) |
| ***F01D 19/02*** | (2006.01) |
| ***F01K 7/16*** | (2006.01) |
| ***F22B 35/14*** | (2006.01) |
| ***F22B 35/18*** | (2006.01) |
| ***F01K 23/10*** | (2006.01) |
| ***F22B 1/18*** | (2006.01) |

(52) U.S. Cl.

CPC ..... *F01K 13/02* (2013.01); *F01D 19/02* (2013.01); *F01K 7/16* (2013.01); *F01K 23/10* (2013.01); *F01K 23/101* (2013.01); *F22B 1/1815* (2013.01); *F22B 35/14* (2013.01); *F22B 35/18* (2013.01)

(58) Field of Classification Search

CPC ..... F01K 13/02; F01K 23/10; F01K 23/101; F01K 7/16; F22B 35/18; F22B 35/14; F22B 1/1815; F01D 19/02

See application file for complete search history.

(56) References Cited

U.S. PATENT DOCUMENTS

| | | |
|---|---|---|
| 4,091,450 A | 5/1978 | Bloch et al. |
| 5,044,152 A | 9/1991 | Hoizumi et al. |

(Continued)

FOREIGN PATENT DOCUMENTS

| | | |
|---|---|---|
| DE | 39 15 478 | 11/1989 |
| DE | 10 2004 058171 | 4/2006 |
| EP | 1 744 020 | 1/2007 |

OTHER PUBLICATIONS

International Search Report for PCT/IB2012/051450, mailed Jun. 20, 2012, 3 pages.

*Primary Examiner* — Carlos A Rivera
(74) *Attorney, Agent, or Firm* — Morrison & Foerster LLP

(57) ABSTRACT

To start a combined cycle thermal plant for energy-production from an off-state to an operational state, once the minimum warm-up time of the steam turbine (ST) having been set, as well as the pressure of the warm-up steam, it is necessary to determine the steam optimum temperature to avoid stressing or straining the mechanical parts of the turbine itself.

9 Claims, 2 Drawing Sheets

(56) References Cited

U.S. PATENT DOCUMENTS

Figure 1:
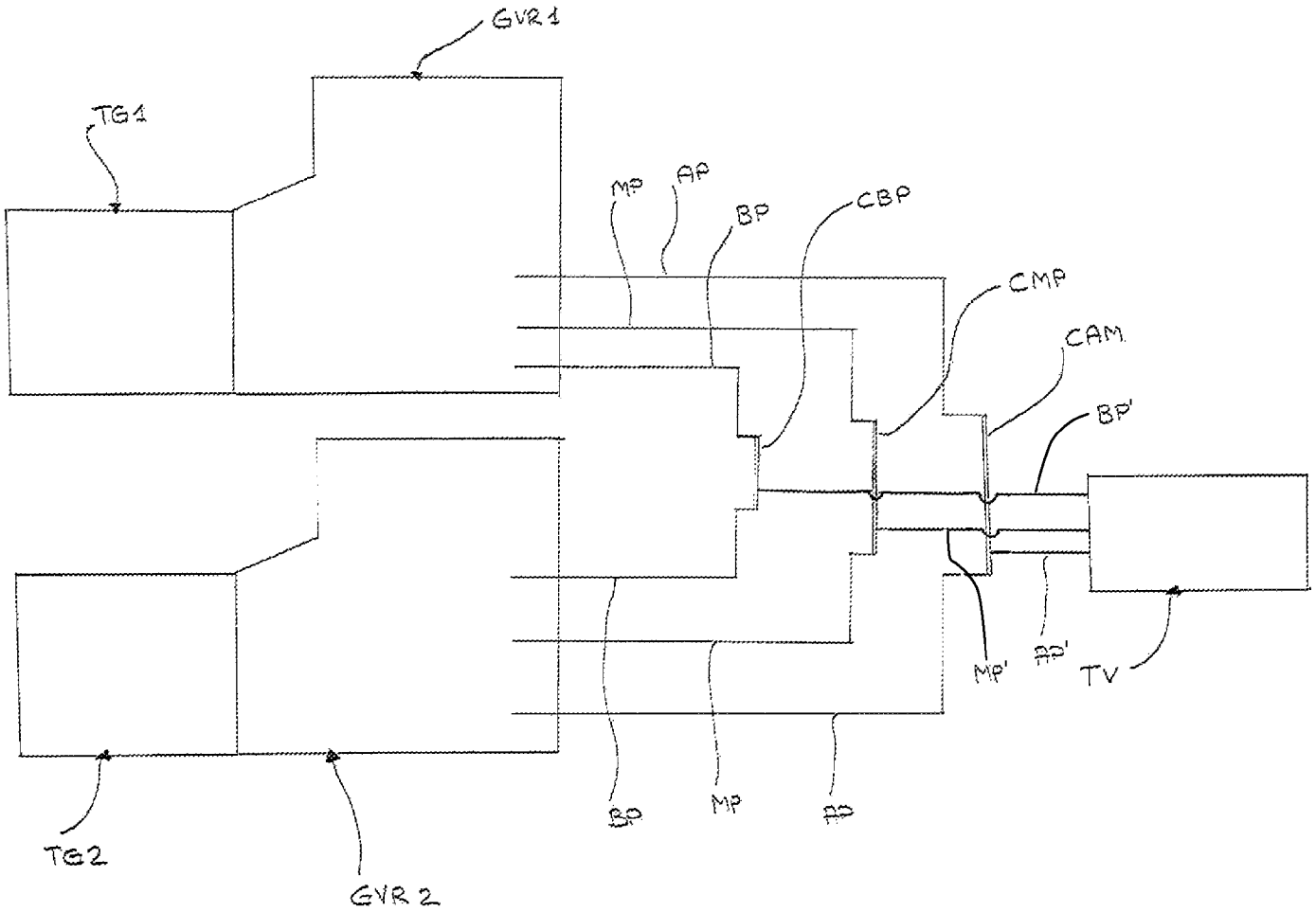

| | | | | |
|---|---|---|---|---|
| 2004/0088984 | A1* | 5/2004 | Gobrecht | F01D 25/10 60/653 |
| 2007/0214766 | A1* | 9/2007 | Obana | F01K 9/04 60/39.15 |
| 2009/0217665 | A1 | 9/2009 | Holzhauer et al. | |
| 2011/0225972 | A1* | 9/2011 | Bruckner | F01K 13/02 60/645 |

* cited by examiner

METHOD TO START UP A COMBINED CYCLE THERMAL PLANT FOR ENERGY PRODUCTION FROM AN OFF-STATE TO AN OPERATIONAL STATE

CROSS-REFERENCE TO RELATED APPLICATIONS

This application is the national phase of PCT application PCT/IB2012/051450 having an international filing date of 27 Mar. 2012, which claims benefit of Italian application Nos. MI2011A000498, filed 28 Mar. 2011 and MI2011A000520, filed 30 Mar. 2011. The contents of the above patent applications are incorporated by reference herein in their entirety.

The present invention refers to a method for the start-up of a combined cycle thermal plant for energy production from an off-state to an operational state according to the preamble of claim 1.

Within the range of the present invention, expressions like "functional group" and similar expressions indicate a precisely set sequence of successive operations automatically operated and linked between them; substantially said expressions are used to indicate a macro-instruction formed by a plurality of minor instructions linked between them both functionally and temporally.

Plants for the production of electric energy of the above specified type are known as combined cycle plants since they have a recovery steam cycle subordinate to a first thermal cycle through which they generate electric energy by exploiting one or more gas and generator turbine groups. These energy production plants are widespread nowadays thanks to their high flexibility of use allowing to change within a very large percentage range and in a reasonable lapse of time the quantity of energy produced, while maintaining a good total efficiency once the plant has reached substantially operating conditions.

Advantageously, combined cycle thermal plants can be stopped and started up again within a reduced lapse of time, thus being particularly suit for supplying daily energy need peaks.

To this respect, it must be underlined that what makes the use of said plants lucrative is the possibility of varying from zero to the highest value the energy production, combined to the plant quickness when passing from an off-state to an operational state at the required load.

The requirement to meet when combined cycle plants are concerned is that of determining how long before to start the plant, particularly the first gas turbine, or master gas turbine, in order to have the steam generator pressurized and be able to start the steam turbine so as to supply at the set hour the energy required by the net administrator.

As concerns the gas turbine start-up and the pressurization of its relative steam generator, so as to have steam at the pressure required to feed the steam turbine, it must be underlined that it is easy to determine the timing since:

- the gas turbine needs a start-up time of about 15 minutes to cause the gas turbine reach the minimum technical level set for this specific turbine and
- the steam generator is pressurized according to a constant C.°/minute pressure increase ratio, specifying that this ratio may differ according to the steam generator start-up state, i.e. a "cold", "warm" or "hot" state.

Differently, the start-up of the steam turbine positioned after the gas turbine and the steam generator groups is a more delicate operation since feeding the turbine stages with too hot or too cold steam with respect to the temperature of the turbine stages themselves would cause these stages a thermal stress and strain which could jeopardize their goods functioning irreversibly or cause an early ageing.

To avoid thermal stress to the turbine stages, especially high and medium pressure stages, the best solution would be to maximize the warm-up time of the turbine.

Basically, while the timing of the start-up operations of the gas turbine and of the following pressurization of the steam generator up to the required value can be easily estimated, the warm-up timing of the steam turbine changes according to the specific temperature starting conditions of the turbine.

All the above being stated, it is self-evident that managing thermal combined cycle plants for the production of electric energy is particularly difficult during the so called transient phases, namely the transient phase where the plant turns from an off-state to an operational state.

At present, if from an off-state the plant needs to be started up quickly to face a scheduled energy request by the net administrator, the plant will be started early enough relying on the operator's experience who manages the plant functioning to avoid stressing the steam turbine stages too much while also trying to minimize the steam turbine warm-up in consideration of the aforementioned reasons.

It is almost unnecessary to remark that the aleatory and decisional discretionary power of the operator handling the plant functioning to reduce as much as possible the warm-up time of the steam turbine without jeopardizing its structure may be considered as a problem.

From the above stated, it highlights the need to operate the combined cycle plants of the aforementioned type with a start-up sequence being able, in the shortest possible delay, to turn the plant from an off-state to a totally operational state, through a start-up procedure:

- being as optimized as possible, in order to reduce the mechanical and thermal stress of the components, namely of the steam turbine stages,
- allowing to reduce at minimum the transient phases timing, especially of the steam turbine warm-up and
- allowing reducing at minimum possible errors by limiting chiefly the discretionary power of the operator.

The problem at the basis of the present invention is that of devising and developing a method for the start-up of a combined cycle thermal plant for the production of electric energy from an off-state to an operational state able to meet said needs, while also solving aforementioned drawbacks with reference to the prior art.

This problem is solved by a method for the start-up of a combined cycle thermal plant for energy production from an off-state to an operational state according to claim 1.

Figure 2:
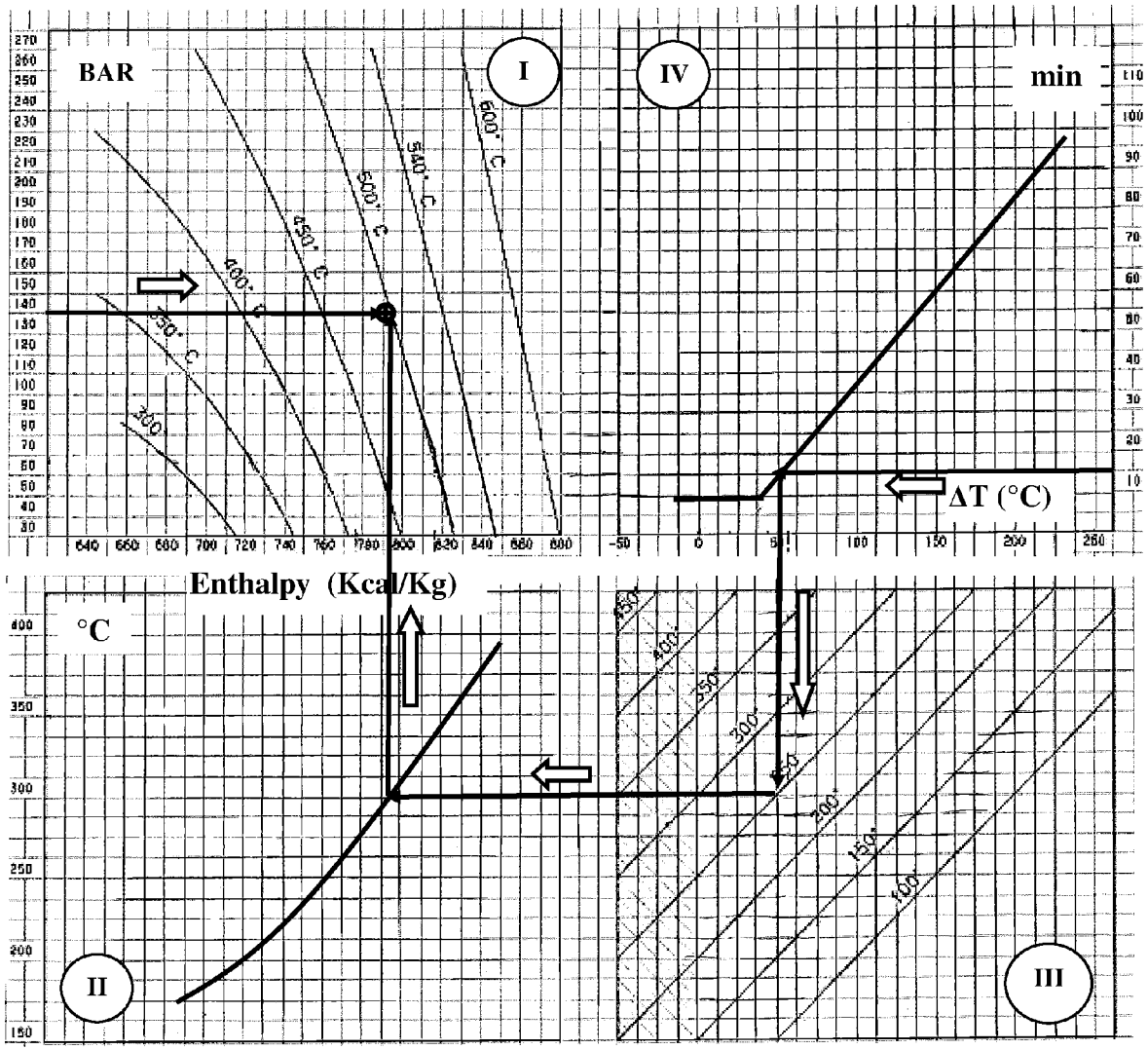

Further features and advantages of the method according to this invention will enhance from the description hereinafter detailed of one preferred example embodiment thereof, given for indicating and not limiting purposes, with reference to the following figures:

FIG. 1 represents a schematic and diagram view of a combined cycle thermal plant for energy production wherein to implement the method according to this invention and FIG. 2 shows the typical curves of a steam turbine.

In accordance with what shown in FIG. 1, the thermal plant for energy production comprises:

- a first TG1 gas turbine and generator group,
  - a first GRV1 recovery steam generator to regenerate the latent heat of the exhaust gases of the first TG1 gas turbine and generator group;
- a second TG2 gas turbine and generator group, a second GRV2 recovery steam generator to regenerate the latent heat of the exhaust gases of the second TG2 gas turbine and generator group;

a TV steam turbine with low, medium and high pressure stages being in fluid communication with the first GRV1 steam generator through steam lines at high, medium and low pressure, AP, MP and BP respectively;

a CAP high pressure steam collector, a CMP medium pressure steam collector and a CBP low pressure steam collector to create a steam parallelism at high, medium and, respectively, low pressure between the first GRV1 steam generator and the second GRV2 steam generator, the CAP high pressure steam collector, the CMP medium pressure steam collector and the CBP low pressure steam collector being respectively in fluid communication with AP' steam lines at high pressure, MP' at medium pressure and BP' at low pressure through which the different stages of the TV steam turbine are fed and a generator coupled to the steam turbine.

Each said stage of the TV steam turbine comprises its respective nozzle/steam distributor through which steam is introduced inside the wheel chamber of its respective high, medium and low pressure stage.

According to this invention the plant also comprises valve means and similar means opening or closing which it is possible to change the plant working conditions. Said valve means are not illustrated in the figure scheme and are not detailed hereinafter since they are well known to a technician of the sector.

Furthermore, the plant according to this invention comprises detection and check means to monitor and detect a plurality of parameters connected to the state of the different components of said plant, namely: of the TG1 and TG2 first and second gas turbine and generator group, of the GRV1 and GRV2 first and second steam generator and of TV steam turbine. Particularly, said means can monitor physical parameters like temperature, pressure, delivery, etc., or parameters connected to the functioning conditions such as the opening or closing state of a valve or the revolution speed of a rotor etc.

Advantageously, the plant according to this invention comprises a DCS control and processing unit (not illustrated in the figure for the sake of simplicity of representation) where to memorize:

each single functional group sequence necessary to obtain the start/stop of each component of the plant starting from the plant being partially or totally off and/or operational and the different plant conditions to be detected by the detection and check means to then give the green light to the execution of the functional groups still to be executed.

Advantageously, the control and processing unit is connected to said detection and check means in order to:

acquire and process information concerning the functioning and/or malfunctioning state of the different components of the plant and further to a request for a specific start/stop sequence among the memorized start/stop sequences, set in operation automatically and in succession the functional groups of said specific sequence, subordinate to the detection by the monitoring means of all the different necessary plant conditions needing to be verified in order to allow the start-up of each functional group, by checking the correct execution of each functional group having been started up.

As results from what above detailed, in the plant control and processing unit it is possible to memorize the sequences of functional groups in addition to the single functional group, i.e. more functional groups linked between them according to an optimal and set sequence, corresponding to the different start-up or stop procedures, both total or partial, of the plant according to the invention. At the same time, in said plant control and processing unit it is also possible to memorize the specific and different local conditions of the different plant components and of the remaining parts of the plant itself which must be detected to give the green light for the execution of the functional groups still to be executed. This is possible thanks to the fact that the plant control and processing unit continuously detects the specific and different local conditions of the plant components and of the further parts of the plant itself while comparing the detected values with the reference values (i.e. suitable to give the permission) and when finds a value correspondence allows the automatic starting of the following functional groups of the specific start/stop sequence required.

Substantially, the plant control and processing unit allows the automatic and linked execution of the different functional groups that compose the required sequence thanks to a systematic and automatic control suitable to give the green light to the execution of a specific functional group as soon as the values detected by the control and detection means after having been communicated to the control and processing unit meet the requirements memorized in the control and processing unit to give the consensus for the execution of the functional groups still to be executed.

Therefore, the linkage between the different functional groups necessary to have a start-up or stop sequence, total or partial, of the plant, does not depend on the experience and free will of the plant operator any longer, but is assured in its best and repeatable form, by the control and processing unit of the plant.

Specifically referring to the start-up procedure of the combined cycle thermal plant as above detailed starting from an off-state to get to a fully operational state, i.e. having both the turbine and steam generator groups working and the steam parallelism executed to feed the steam turbine, the start-up phases comprise, in order, the following functional groups sequence:

GF1A: prearrangement of the start up of said first TG1 gas turbine and generator group;

GF2A: Start up of said first TG1 gas turbine and generator group and pressurization of said first GRV1 steam generator;

GF3A: Warm up and load increase of said TV steam turbine after the start-up of said first TG1 gas turbine and generator group with vacuum in the condenser;

GF4A: prearrangement of the start-up of said second TG2 gas turbine and generator group;

GF5A: Start-up of said second TG2 gas turbine and generator group and pressurization of said second GRV2 steam generator and GF6A: Insertion of a steam parallelism between said second GRV2 steam generator and said first GRV1 steam generator through said CAP high pressure steam, CMP medium pressure and CBP low pressure collectors feeding respectively said high, medium and low pressure stages of said TV steam turbine.

The start-up time of the plant from an off-state to a configuration where a first TG1 turbine and generator group is set in operation and the TV steam turbine is activated comprise the sum of the following times:

washing and start-up time of TG1 gas turbine;

pressurization time of GRV1 steam generator and warm-up time of TV1 steam turbine and load increase time of TV steam turbine.

As concerns the washing and start-up time of TG1 gas turbine (up to the synchronization) the total time is generally 15 minutes.

The pressurization time of GRV1 steam generator may be determined in the following way:

determine the specific pressure increase ratio in time of GRV1 steam generator on the basis of the features of GRV1 specific steam generator and of the thermal load transferred to said GRV1 steam generator by the gases of TG1 gas turbine;

detect the initial temperature inside GRV1 steam generator;

calculate the difference in temperature between the steam temperature necessary to warm up TV steam turbine and said initial temperature inside GRV1 steam generator;

define the minimum pressurization time for GRV1 steam generator by dividing said difference in temperature by said pressure increase ratio of the steam generator.

The pressurization time of the steam generator is generally about thirty minutes (for hot start-up) and ninety minutes (for cold start-up).

As a rule, the preferred $T_r$ warm-up time is to be comprised within three hours (for cold starts) and fifteen minutes (for hot starts)

Once having defined both the $T_r$ warm-up time and the pressure needed to execute the warm-up, more specifically the $P_h$ warm-up pressure for the high pressure stage and the $P_m$ warm-up pressure for the low pressure stage, you must determine the warm-up steam temperature so as to avoid that TV steam turbine stages undergo excessive thermal stresses and/or strain which could irreversibly jeopardize their good functioning.

To this purpose the $\theta_{v1}$ steam optimum temperature to be introduced in the high pressure stage of TV steam turbine in order to execute the warm-up in the $T_r$ set time with steam at $P_h$ set pressure can be determined as follows:

a) establishing for the specific TV steam turbine a correlation between the minimum warm-up time to be implemented for TV steam turbine taking into account the difference in temperature between the temperature of the steam introduced inside the wheel chamber of the high pressure stage of TV steam turbine and the metal temperature of the wheel chamber of the high pressure stage of TV steam turbine;

b) determining on the basis of said set $T_r$ warm-up time and of said correlation the maximum $\Delta\theta_1$ allowable difference in temperature between the temperature of the steam introduced in the wheel chamber of the high pressure stage and the temperature of the metal of the wheel chamber of the high pressure stage;

c) detecting the $\theta_{m1}$ temperature of the wheel chamber metal of the high pressure stage;

d) determining, taking into account the geometrical and structural features of the specific nozzle/steam distributor, the $\Delta H_1$ enthalpy drop corresponding to the enthalpy decrease that the steam undergoes when passing through the nozzle/steam distributor of the high pressure stage;

e) determining the $H_1$ calculated enthalpy of the steam to be introduced into TV turbine by making the algebraic sum of said $\Delta H_1$ enthalpy drop and the enthalpy of some steam having a pressure equal to said $P_h$ warm-up pressure and a temperature equal to the algebraic sum of said $\theta_{m1}$ detected temperature of the wheel chamber metal of the high pressure stage and of said maximum allowable difference in $\Delta\theta 1$ temperature;

f) on the basis of said $H_1$ calculated enthalpy and of said set $P_h$ warm-up pressure determine the $\theta_{v1}$ temperature of the steam to be introduced inside TV steam turbine so as to be able to warm up said TV steam turbine within said $T_r$ set warm-up time through a steam at $P_h$ warm-up pressure.

Preferably, if the turbine comprises more stages, it is advisable to repeat steps from a) to f) for the medium pressure stage also. Therefore, the $\theta_{v2}$ temperature of the steam to be introduced inside the medium pressure stage of TV steam turbine so as to be able to warm up said TV steam turbine within said $T_r$ set warm-up time with steam at $P_m$ pressure is properly calculated in the following way:

a') establishing for the specific TV steam turbine a correlation between the minimum warm-up time to be implemented for TV steam turbine taking into account the difference in temperature between the temperature of the steam introduced inside the wheel chamber of the medium pressure stage of TV steam turbine and the wheel chamber metal temperature of the medium pressure stage of TV steam turbine;

b') determining on the basis of said set $T_r$ warm-up time and of said correlation the maximum $\Delta\theta_2$ allowable difference in temperature between the temperature of the steam introduced in the wheel chamber of the medium pressure stage and the temperature of the wheel chamber metal of the medium pressure stage;

c') detecting the $\theta_{m2}$ temperature of the wheel chamber metal of the medium pressure stage;

d') determining, taking into account the geometrical and structural features of the specific nozzle/steam distributor, the $\Delta H_2$ enthalpy drop corresponding to the enthalpy decrease the steam undergoes when passing through the nozzle/steam distributor of the medium pressure stage;

e') determining the $H_2$ calculated enthalpy of the steam to be introduced into TV turbine by making the algebraic sum of said $\Delta H_2$ enthalpy drop and the enthalpy of a steam having a pressure equal to said Pm warm-up pressure and a temperature equal to the algebraic sum of said detected $\theta_{m2}$ temperature of the wheel chamber metal of the medium pressure stage and of said maximum allowable difference in $\Delta\theta 2$ temperature;

f') on the basis of said $H_2$ calculated enthalpy and of said set $P_m$ warm-up pressure determine the $\theta_{v2}$ temperature of the steam to be introduced inside TV steam turbine so as to be able to warm up said TV steam turbine within said $T_r$ set warm-up time through steam at $P_m$ warm-up pressure.

Once it having been determined the $\theta_{v1}$ perfect steam temperature for the high pressure stage and the $\theta_{v2}$ perfect steam temperature for the medium pressure stage, it is necessary to choose the gas turbine load so as to generate steam having a temperature as close as possible to the set $\theta_{v1}$ e$\theta_{v2}$ best detected values, also by cooling, if necessary, the steam for the stage needing a lower temperature steam.

Therefore the TV steam turbine is warmed up by steam having a temperature equal to the highest temperature between said $\theta_{v1}$ set temperature for the high pressure stage and said $\theta_{v2}$ set temperature for the medium pressure stage.

In order to have an even heating of each stage of TV steam turbine it is advisable to lengthen the warm-up time by one or more time intervals, during which the steam turbine rotates at an intermediate constant speed.

Once the specific features of the plant known, namely of TV steam turbine and of the nozzle/steam distributor s geometry, said correlations and said enthalpy drops, along with the values connecting the steam enthalpy to pressure and volume, can be entered in the control and process unit of the plant, so that said control and process unit will automatically determine both the $\theta_{v1}$ steam temperature most suitable for the high pressure stage and the $\theta_{v2}$ steam temperature most suitable for the medium pressure stage.

As an alternative, it is self-evident that it is possible to determine the $\theta_v$ perfect steam temperature for one specific turbine stage by using graphs like the graphs shown in FIG. 12, commonly known as mismatch cards.

With reference to FIG. 2 it is underlined that this same figure shows four graphs, labelled respectively with I, II, III e IV to be explained as follows.

Graph I

It reports on the axis of abscissae the enthalpy value (expressed in Kcal/kg in the example) of the steam introduced in the TV steam turbine stage.

It reports the steam pressure (expressed in BAR in the example) on the axis of ordinates.

The reported isotherm lines allow to calculate the steam enthalpy at a set pressure taking into account the specific temperature (expressed in ° C. in the example) of the steam in a specific moment. It is a physical correlation independent from the type of steam turbine being used. Therefore, graph I indicates the steam enthalpy value once pressure and temperature having been set.

Graph II

It reports on the axis of abscissae the enthalpy value (expressed in Kcal/kg in the example) of the steam introduced in the TV steam turbine.

It reports on the axis of ordinates the steam temperature (expressed in ° C. in the example) after the nozzle/steam distributor through which the steam must pass to enter the wheel chamber of the turbine stage.

Practically:

once the steam warm-up enthalpy known, i.e. the steam enthalpy necessary to feed the TV steam turbine, and once the specific configuration of said nozzle/steam distributor known, it is possible to determine the enthalpy drop, namely the enthalpy decrease, of the steam while passing through said nozzle/steam distributor, so as to determine the exact temperature of the steam while entering the wheel chamber of the steam turbine stage.

Obviously, since while passing through said nozzle/steam distributor, steam undergoes a loss in enthalpy, the steam temperature on entering the wheel chamber of the TV steam turbine stage will always be lower than the temperature of steam introduced in TV steam turbine.

Then, taking into account the features of the specific nozzle/steam distributor, graph II reports the relation through which it is possible to determine the temperature of the steam introduced in the wheel chamber of the steam turbine stage on the basis of the enthalpy of the steam having been introduced, that is to say taking into account the temperature and pressure introduced in the TV steam turbine. This relation can be calculated theoretically taking into account the geometry of the specific nozzle/steam distributor and, as an alternative, can be noted down by way of experiment during the functioning of the turbine or by testing separately the nozzle/steam distributor.

The relation reported in graph II has been formulated by the steam turbine producer and is included in the handbook going with the steam turbine.

Graph III

It reports on the axis of abscissae the ΔT difference in temperature (expressed in ° C.) between the temperature of the steam introduced in the first chamber of the TV steam turbine stage and the metal temperature of the first chamber of the TV steam turbine stage.

On the axis of ordinates it reports the temperature (expressed in ° C. in the example) of the steam introduced in the wheel chamber of the TV steam turbine stage, that is to say of the steam after said nozzle/steam distributor through which the steam must pass to enter the wheel chamber of the turbine stage.

Once you know the temperature of the wheel chamber metal of the turbine stage, represented by one of the isotherm lines (expressed in ° C. in the example), reporting in the graph on the axis of ordinates the value of the steam temperature introduced in the wheel chamber up to intersecting horizontally the isotherm line corresponding to the value of the metal temperature of the turbine wheel chamber, you will read on the axis of abscissae the value of the ΔT difference in temperature (expressed in ° C. in the example) between the inlet steam temperature and the wheel chamber metal temperature of the turbine stage.

Graph IV

It reports on the axis of abscissae the ΔT difference in temperature (expressed in ° C.) between the temperature of the steam introduced in the first chamber of the TV steam turbine stage and the metal temperature of the wheel chamber of the TV steam turbine stage. On the axis of ordinates it reports the warm-up time (expressed in minutes) of the steam turbine.

Basically, the line in graph IV defines a correlation suitable to underline the minimum warm-up time of TV steam turbine taking into account the difference in temperature between the temperature of the steam introduced in the wheel chamber of TV steam turbine stage and the temperature of the metal of TV steam turbine stage. Substantially by choosing a time combination of warm-up time and of the ΔT difference in temperature along the graphic line you can be sure of avoiding to stress thermally and structurally the steam turbine stage (TV).

For each specific TV steam turbine, the producer of the steam turbine has developed graph IV and includes it in the documents supplied with the steam turbine.

It goes without saying it being necessary to count with said graphs for each stage of the steam turbine you need to calculate the perfect temperature of steam to be introduced without stressing the turbine and minimizing the warm-up time of the turbine itself.

For example, with reference to graphs of FIG. 2, if you want to warm up the steam turbine within fifteen minutes having a temperature of the metal of the stage first chamber of 250° C. and a steam pressure of 140 bar, on the basis of said graphs you will have an optimum steam temperature equal to 500° C.

To obtain said value it is necessary to:

follow the axis of ordinates in graphic IV with the chosen warm-up time as far as you meet the optimum curve;

go down as far as meeting in graph III the isotherm curve corresponding to the surveyed temperature of the wheel chamber metal (in the example 250° C.);

move along the axis of abscissae in graph III up to meeting the represented curve;

go up from graph II as to meet the isobar corresponding to the pressure value of the available steam (in the example 140 BAR) and, in the intersection point so defined read the temperature steam value identified by the isothermal line passing by said intersection point.

As can be appreciated from what has been described, the method according to the present invention allows meeting above mentioned needs and at the same time overcoming the drawbacks referred to in the introductory part of the present description with reference to the prior art. As a matter of fact, even when defining a warm-up time short at will (generally not lower than ten minutes), so as to reduce the plant start-up time, thanks to the method according to the present invention it is possible to determine the exact temperature of the steam to be produced in the steam generator so as to be able to warm up the steam turbine within said time without exerting thermal stress and/or excessive mechanical strain on the turbine components.

Obviously, a technical expert, may apply several modifications and arrangements to the above detailed method in order to satisfy contingent and specific needs but without exceeding the range of the protection of the present invention as defined by the following claims.

The invention claimed is:

1. A method to minimize time for the start up of a combined cycle thermal plant for energy production from an off-state to an operational state, said combined cycle thermal plant for energy production comprising a first gas turbine and generator group (TGI), a first recovery steam generator (GRV1) to regenerate latent heat of exhaust gases of said first gas turbine and generator group (TGI), a steam turbine (TV), a generator coupled to said steam turbine (TV), and a nozzle/steam distributor, wherein:

said first recovery steam generator (GRV1) is in fluid communication with said steam turbine (TV), said first recovery steam generator (GRV1) is kinematicly coupled to said steam turbine (TV) to be rotationally operated and, said combined cycle thermal plant is configured to monitor and detect a plurality of parameters connected to the correct functioning and/or malfunctioning of said first gas turbine and generator group (TGI) and said first recovery steam generator (GRV1) and, respectively of said steam turbine (TV), a first stage of said steam turbine comprises a wheel chamber to be fed with steam produced by said first recovery steam generator (GRV1) through a nozzle/steam distributor, wherein the start-up phases of the combined cycle thermal plant starting from an off-state comprise, in order, the following sequence of functions:

GF1A: prearranging said first gas turbine and generator group (TGI) for start-up;

GF2A: starting-up of said first gas turbine and generator group (TGI) and pressurizing of said first recovery steam generator (GRV1);

GF3A: warming-up and increasing load of said steam turbine (TV) with steam at a set pressure coming from said first recovery steam generator (GRV1);

wherein the start-up time of the combined cycle thermal plant starting from an off-state comprises the sum of the following times:

time for washing and start-up time of the first gas turbine and generator group (TGI);

pressurizing time of the first recovery steam generator (GRV1) and warm-up time of the steam turbine (TV);

wherein a steam optimum temperature ($\theta_{v1}$) to be introduced in the steam turbine in order to execute the warm-up of said steam turbine (TV) with steam at a set warm-up pressure ($P_h$) and for a set warm-up time ($T_r$) is determined as follows:

a) establishing for the steam turbine (TV) a correlation between a minimum warm-up time to be implemented for the steam turbine (TV) taking into account any difference in temperature between a temperature of steam introduced inside the wheel chamber of said first stage of the steam turbine (TV) and a metal temperature ($\theta_{m1}$) of the wheel chamber of said first stage of the steam turbine (TV), b) determining, on the basis of said set warm-up time ($T_r$) and of said correlation, a maximum allowable difference in temperature ($\Delta\theta_1$) between the temperature of the steam introduced in the wheel chamber of said first stage of the steam turbine (TV) and the metal temperature ($\theta_{m1}$) of the wheel chamber of said first stage of the steam turbine (TV);

c) detecting the metal temperature ($\theta_{m1}$) of the wheel chamber of said first stage of the steam turbine (TV);

d) determining, taking into account the geometrical and structural features of the nozzle/steam distributor, an enthalpy drop ($\Delta H_1$) corresponding to the enthalpy decrease steam undergoes when passing through said nozzle/steam distributor;

e) determining a calculated enthalpy ($H_1$) of steam to be introduced into the steam turbine (TV) by making the algebraic sum of said enthalpy drop ($\Delta H_1$) and an enthalpy of steam having a pressure equal to said warm-up pressure ($P_h$) and a temperature equal to the algebraic sum of said detected metal temperature ($\theta_{m1}$) of the wheel chamber of said first stage and of said maximum allowable difference in temperature ($\Delta\theta_1$);

f) determining, on the basis of said calculated enthalpy ($H_1$) and of said set warm-up pressure ($P_h$), the steam optimum temperature ($\theta_{v1}$) to be introduced inside the steam turbine (TV) so as to be able to warm up said steam turbine (TV) within said set warm-up time ($T_r$) with steam at said set warm-up pressure ($P_h$).

2. The method of claim 1, wherein:

said steam turbine (TV) is a multi-stage steam turbine comprising high, medium and low pressure stages;

said first recovery steam generator (GRV1) is in fluid communication through steam lines at high, medium and low pressure having corresponding stages at high, medium and low pressure of said steam turbine (TV), each one of said stages comprising a corresponding wheel chamber to be fed with steam through a respective nozzle/steam distributor, said first stage is the high pressure stage of said steam turbine (TV) and said warm-up pressure ($P_h$) is the warm-up pressure of said high pressure stage.

3. The method of claim 2, wherein said medium pressure stage is warmed up with steam having a pressure ($P_m$) during said warm-up time ($T_r$), the method further comprising:

determining a second steam optimum temperature ($\theta_{v2}$) to be introduced in the medium pressure stage of the steam turbine (TV) by repeating steps a) to f) for the medium pressure stage; and choosing a gas turbine load so as to generate steam having a temperature as close as possible to one of the sets $\theta_{v1}$ and $\theta_{v2}$.

4. The method of claim 1, wherein said warm-up time ($T_r$) is comprised within fifteen minutes and ninety minutes.

5. The method of claim 2, wherein said combined cycle thermal plant comprises:

a second gas turbine and generator group (TG2), a second recovery steam generator (GRV2) to regenerate latent heat of exhaust gases of said second gas turbine and generator group (TG2);

said second recovery steam generator (GRV2) being in fluid communication through a high pressure steam collector (CAP), through a medium pressure steam collector (CMP) and through a low pressure steam collector (CBP) with said high, medium and low pressure steam lines of said first recovery steam generator (GRV1) to feed said high, medium and low pressure stages of said steam turbine (TV) through a steam parallelism at high, medium and low pressure between said first recovery steam generator (GRV1) and said second recovery steam generator (GRV2), the method further comprising:

GF4A: prearranging said second gas turbine and generator group (TG2) for start-up;

GF5A: starting-up of said second gas turbine and generator group (TG2) and pressurization of said second recovery steam generator (GRV2) and GF6A: inserting of a steam parallelism between said second recovery steam generator (GRV2) and said first recovery steam generator (GRV1) through said steam collectors at high (CAP), medium (CMP) and low (CBP) pressure respectively feeding said high, medium and low pressure stages of said steam turbine (TV).

6. The method of claim 1, wherein said pressurization time of the first recovery steam generator (GRV1) is determined in the following way:

defining a pressure increase rate of the first recovery steam generator (GRV1) on the basis of first recovery steam generator (GRV1) features and of a thermal load transferred to said first recovery steam generator (GRV1) by exhaust gases of the first gas turbine and generator group (TGI);

detecting an initial temperature inside the first recovery steam generator (GRV1);

calculating a difference in temperature between a steam temperature necessary to warm up the steam turbine (TV) and said initial temperature inside the first recovery steam generator (GRV1);

defining a minimum time necessary to pressurize the steam generator (GRV1) by dividing the difference in temperature between the steam temperature necessary to warm up the steam turbine (TV) and the initial temperature inside the first recovery steam generator (GRV1) by said pressurization increase rate of the first recovery steam generator (GRV1).

7. The method of claim 1, wherein said washing and, start-up time of the first gas turbine and generator group (TGI) is about fifteen minutes.

8. The method of claim 1, wherein said warm-up time of the steam turbine (TV) is lengthened of at least one additional lapse of time during which the steam turbine (TV) is caused to rotate at an intermediate constant rotation speed in order to obtain an even warming up of each single stage of the steam turbine (TV).

9. The method of claim 8, wherein said additional lapse of time is equal to at least five minutes.

* * * * *